US009877111B2

(12) United States Patent
Burleson et al.

(10) Patent No.: US 9,877,111 B2
(45) **Date of Patent: *Jan. 23, 2018**

(54) LOUDSPEAKER ASSEMBLY CONFIGURATION

(71) Applicant: Sonos, Inc., Santa Barbara, CA (US)

(72) Inventors: Mark Burleson, Goleta, CA (US); Richard Warren Little, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/235,840

(22) Filed: Aug. 12, 2016

(65) Prior Publication Data

US 2016/0353207 A1 Dec. 1, 2016

Related U.S. Application Data

(63) Continuation of application No. 14/714,618, filed on May 18, 2015, now Pat. No. 9,451,345, which is a (Continued)

(51) Int. Cl.
*H04R 9/06* (2006.01)
*H04R 9/04* (2006.01)
(Continued)

(52) U.S. Cl.
CPC ..... *H04R 9/06* (2013.01); *H04R 1/00* (2013.01); *H04R 7/12* (2013.01); *H04R 7/16* (2013.01); *H04R 9/025* (2013.01); *H04R 9/04* (2013.01); *H04R 9/043* (2013.01); *H04R 31/00* (2013.01); *H04R 2400/11* (2013.01); *Y10T 29/49575* (2015.01)

(58) Field of Classification Search
CPC ..... H04R 9/04; H04R 9/043; H04R 31/00; Y10T 29/49575
See application file for complete search history.

(56) References Cited

U.S. PATENT DOCUMENTS 5,440,644 A 8/1995 Farinelli et al.
5,761,320 A 6/1998 Farinelli et al.
(Continued)

FOREIGN PATENT DOCUMENTS

EP 1389853 A1 2/2004
WO 03093950 A2 11/2003
WO 2012113281 8/2012

OTHER PUBLICATIONS

AudioTron Quick Start Guide, Version 1.0, Mar. 2001, 24 pages.
(Continued)

*Primary Examiner* — Tuan D Nguyen
(74) *Attorney, Agent, or Firm* — McDonnell Boehnen Hulbert & Berghoff LLP

(57) ABSTRACT

Embodiments are provided for configurations of a loudspeaker and assembly of the loudspeaker. The loudspeaker may include a frame, a voice coil, a magnetic structure that includes a magnetic gap, a surround, a spider, and a circumferential spacer element. The circumferential spacer element may include a first tier attached to an outer rim of the surround; and a second tier attached to an outer rim of the spider, wherein the circumferential spacer element is coupled to the frame such that the voice coil is suspended at least partially within the magnetic gap.

20 Claims, 6 Drawing Sheets

Related U.S. Application Data continuation of application No. 14/021,831, filed on Sep. 9, 2013, now Pat. No. 9,066,179.

(51) Int. Cl.

| | |
|---|---|
| ***H04R 31/00*** | (2006.01) |
| ***H04R 1/00*** | (2006.01) |
| ***H04R 7/12*** | (2006.01) |
| ***H04R 7/16*** | (2006.01) |
| ***H04R 9/02*** | (2006.01) |

(56) References Cited

U.S. PATENT DOCUMENTS

| | | | |
|---|---|---|---|
| 6,032,202 | A | 2/2000 | Lea et al. |
| 6,236,733 | B1 | 5/2001 | Kato et al. |
| 6,469,633 | B1 | 10/2002 | Wachter |
| 6,778,869 | B2 | 8/2004 | Champion |
| 6,938,726 | B1 | 9/2005 | Roark et al. |
| 7,236,607 | B2 | 6/2007 | D'Hoogh et al. |
| 7,295,548 | B2 | 11/2007 | Blank et al. |
| 7,483,538 | B2 | 1/2009 | McCarty et al. |
| 7,570,780 | B2 | 8/2009 | Baeten et al. |
| 7,571,014 | B1 | 8/2009 | Lambourne et al. |
| 7,599,511 | B2 | 10/2009 | Corynew et al. |
| 7,630,501 | B2 | 12/2009 | Blank et al. |
| 7,643,894 | B2 | 1/2010 | Braithwaite et al. |
| 7,853,341 | B2 | 12/2010 | McCarty et al. |
| 7,987,294 | B2 | 7/2011 | Bryce et al. |
| 8,031,896 | B2 | 10/2011 | Chick et al. |
| 8,031,897 | B2 | 10/2011 | Bastyr et al. |
| 8,045,952 | B2 | 10/2011 | Qureshey et al. |
| 8,103,009 | B2 | 1/2012 | McCarty et al. |
| 8,189,841 | B2 | 5/2012 | Litovsky et al. |
| 8,234,395 | B2 | 7/2012 | Millington et al. |
| 8,345,892 | B2 | 1/2013 | Jung et al. |
| 8,422,724 | B2 | 4/2013 | Corynen |
| 8,483,853 | B1 | 7/2013 | Lambourne |
| 8,638,968 | B2 | 1/2014 | Gladwin |
| 8,675,899 | B2 | 3/2014 | Jung |
| 8,811,648 | B2 | 8/2014 | Pance et al. |
| 8,934,657 | B2 | 1/2015 | Wilk |
| 2002/0124097 | A1 | 9/2002 | Isely et al. |
| 2004/0075351 | A1 | 4/2004 | Ueda et al. |
| 2004/0165746 | A1 | 8/2004 | Kreitmeier et al. |
| 2005/0008188 | A1 | 1/2005 | Harris |
| 2006/0078153 | A1 | 4/2006 | Sato |
| 2006/0153416 | A1 | 7/2006 | Kaneda et al. |
| 2007/0142944 | A1 | 6/2007 | Goldberg et al. |
| 2009/0026007 | A1 | 1/2009 | Corynen |
| 2009/0116680 | A1 | 5/2009 | Funahashi |
| 2012/0121092 | A1 | 5/2012 | Starobin |
| 2013/0202149 | A1 | 8/2013 | Yoon |
| 2013/0315429 | A1 | 11/2013 | Parker et al. |
| 2014/0140559 | A1 | 5/2014 | Graham |

OTHER PUBLICATIONS

AudioTron Reference Manual, Version 3.0, May 2002, 70 pages.
AudioTron Setup Guide, Version 3.0, May 2002, 38 pages.
Jo et al., "Synchronized One-to-many Media Streaming with Adaptive Playout Control," Proceedings of SPIE, 2002, pp. 71-82, vol. 4861.
"Denon 2003-2004 Product Catalog," Denon, 2003-2004, 44 pages.
United States Patent and Trademark Office, U.S. Appl. No. 60/490,768 filed Jul. 28, 2003, entitled "Method for synchronizing audio playback between multiple networked devices," 13 pages.
United States Patent and Trademark Office, U.S. Appl. No. 60/825,407 filed Sep. 12, 2003, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.
Non-Final Office Action dated Nov. 4, 2014, issued in connection with U.S. Appl. No. 14/021,831, filed Sep. 9, 2013, 11 pages.
Notice of Allowance dated May 19, 2016, issued in connection with U.S. Appl. No. 14/714,618, filed May 18, 2015, 9 pages.
Notice of Allowance dated Feb. 26, 2015, issued in connection with U.S. Appl. No. 14/021,831, filed Sep. 9, 2013, 11 pages.
Preinterview Office Action dated Mar. 22, 2016, issued in connection with U.S. Appl. No. 14/714,618, filed May 18, 2015, 5 pages.

LOUDSPEAKER ASSEMBLY CONFIGURATION

CROSS REFERENCE TO RELATED APPLICATIONS

This application claims priority under 35 U.S.C. § 120 to, and is a continuation of, U.S. patent application Ser. No. 14/714,618, filed on May 18, 2015, entitled "Loudspeaker Assembly Configuration," the contents of which are fully incorporated by reference herein. U.S. patent application Ser. No. 14/714,618 is a continuation of U.S. patent application Ser. No. 14/021,831, filed on Sep. 9, 2013, entitled "Loudspeaker Assembly Configuration," which issued as U.S. Pat. No. 9,066,179 on Jun. 23, 2015, the contents of which are fully incorporated by reference herein.

This application is related to commonly-owned U.S. patent application Ser. No. 14/021,813, entitled "Loudspeaker Configuration," the contents of which are fully incorporated by reference herein.

FIELD OF THE DISCLOSURE

The disclosure is related to consumer goods and, more particularly, to methods, systems, products, features, services, and other items directed to media playback or some aspect thereof.

BACKGROUND

A loudspeaker in the context of the present application is an electroacoustic transducer that produces sound in response to an electrical audio signal input. Originally, non-electrical loudspeakers were developed as accessories to telephone systems. Today, electronic amplification for applications such as audible communication and enjoyment of music has made loudspeakers ubiquitous.

A common form of loudspeaker uses a diaphragm (such as, for example, a paper cone) supporting a voice coil electromagnet acting on a permanent magnet. Based on the application of the loudspeaker, different parameters may be selected for the design of the loudspeaker. For instance, the frequency response of sound produced by a loudspeaker may depend on the shape, size, and rigidity of the diaphragm, and efficiency of the voice coil electromagnet, among other factors. Accordingly, the diaphragm and voice coil electromagnet may be selected based on a desired frequency response of the loudspeaker. In some cases, for improved reproduction of sound covering a wide frequency range, multiple loudspeakers may be used collectively, each configured to optimally reproduce different frequency subranges within the wide frequency range.

As applications of loudspeakers continue to broaden, different loudspeaker designed for particular applications continue to be developed.

BRIEF DESCRIPTION OF THE DRAWINGS

Features, aspects, and advantages of the presently disclosed technology may be better understood with regard to the following description, appended claims, and accompanying drawings where:

DETAILED DESCRIPTION

I. Overview

Embodiments described herein involve loudspeaker configurations and assemblies of the loudspeaker configurations that allow for a loudspeaker to have reduced height. The reduced height of the loudspeaker may allow the loudspeaker to be installed in shallow compartments where conventional non-shallow speakers may not otherwise fit.

Figure 1A:
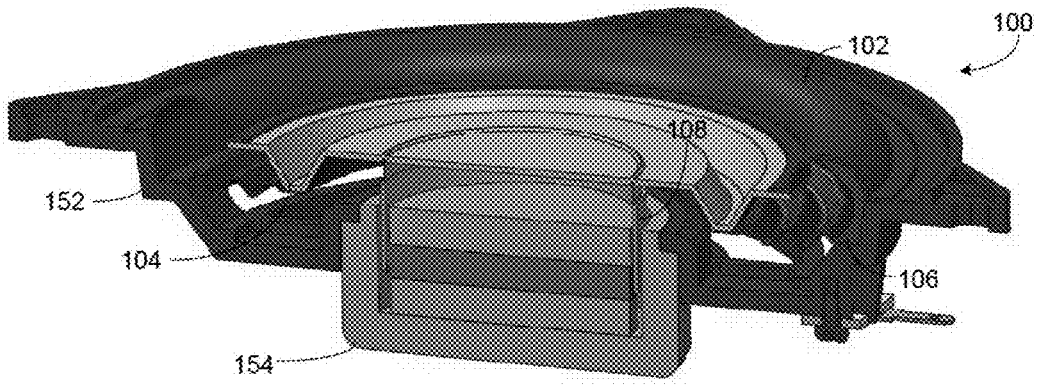
FIG. 1A shows an example first loudspeaker configuration, according to an embodiment of the present application.

FIG. 1A shows an example first loudspeaker configuration, according to an embodiment of the present application. As shown in FIG. 1A, the first loudspeaker configuration 100 includes a first suspension element (or "surround") 102, a continuous diaphragm 104, a second suspension element (or "spider") 106, a loudspeaker frame 152, a magnetic structure 154, and a voice coil 108 configured to be suspended at least partially within the magnetic gap of the magnetic structure 154.

As shown, the continuous diaphragm 104 extends across an inner opening of the first suspension element 102, over the loudspeaker frame 152, and covering a voice coil 108. In this case, the voice coil 108 may be attached to a central portion of a lower surface of the continuous diaphragm 104. Because the voice coil 108 is covered by the diaphragm 104, a dust cap that may be found in conventional loudspeaker configurations may no longer be necessary. Dust caps for covering voice coils in a loudspeaker may add height to the loudspeaker transducer, thereby adding height to the loudspeaker. As such, the loudspeaker configuration 100 as shown in FIG. 1A may have a reduced height because the voice coil 108 is covered by the continuous diaphragm 108 rather than a dust cap. Further, conventional loudspeakers configured with dust caps may require additional component costs and manufacturing time to install the dust cap. As such, a loudspeaker with a continuous diaphragm covering the voice coil may further offer reduced costs and manufacturing time.

As also shown in the loudspeaker configuration 100 of FIG. 1A, the second suspension element 106 may be attached circumferentially between the diaphragm 104 and the loudspeaker frame 152. In some example loudspeaker configurations, the second suspension element, or spider may be attached between a frame of and a voice coil of the conventional loudspeaker instead. Other examples may also be possible.

Figure 1B:
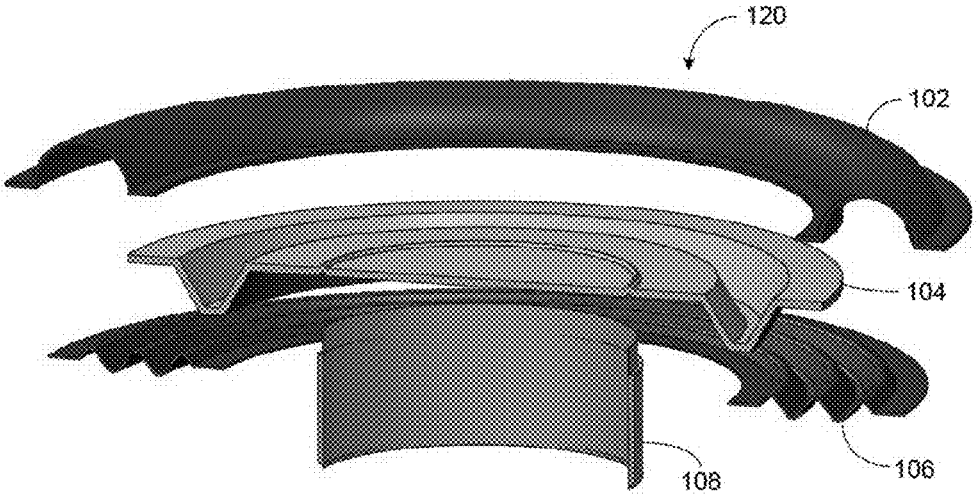
FIG. 1B shows an example first group of components for an example first sub-assembly of the first loudspeaker configuration, according to an embodiment of the present application.

In one example, the loudspeaker configuration 100 may be assembled by first assembling one or more sub-assemblies. For example, FIG. 1B shows an example first group of components for an example first sub-assembly 120 of the first loudspeaker configuration 100, according to an embodiment of the present application. The first sub-assembly 120 may include the first suspension element 102, the second suspension element 106, the continuous diaphragm 104, and the voice coil 108. As shown in FIG. 1B, an inner rim of the first suspension element 102 may be coupled to an outer rim of the continuous diaphragm 104, an inner rim of the second suspension element 106 may be coupled to a lower surface of the continuous diaphragm 104 (or to the voice coil 108), and the voice coil 108 may be coupled to the central portion of the lower surface of the continuous diaphragm 104 as suggested above.

Figure 1C:
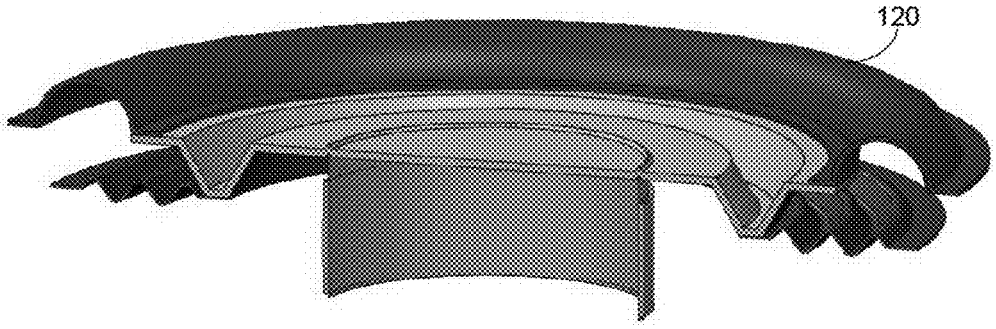
FIG. 1C shows the first sub-assembly of the first loudspeaker configuration, according to an embodiment of the present application.

In one example, the different components may be coupled using different means. For instance, the voice coil 108 may be coupled to the central portion of the lower surface of the continuous diaphragm 104 via a cone coupler. In one case, the first suspension element 102 may be coupled to the continuous diaphragm 104 using an adhesive substance configured to bind the first suspension element 102 to the continuous diaphragm 104. Similarly, the second suspension element 106 may be coupled to the continuous diaphragm 104 or voice coil 108 using a similar, or different adhesive substance configured to bind the second suspension element 106 to the continuous diaphragm 104 or voice coil 108. Other examples are also possible. FIG. 1C shows the first sub-assembly 120 of the first loudspeaker configuration, according to an embodiment of the present application.

Figure 1D:
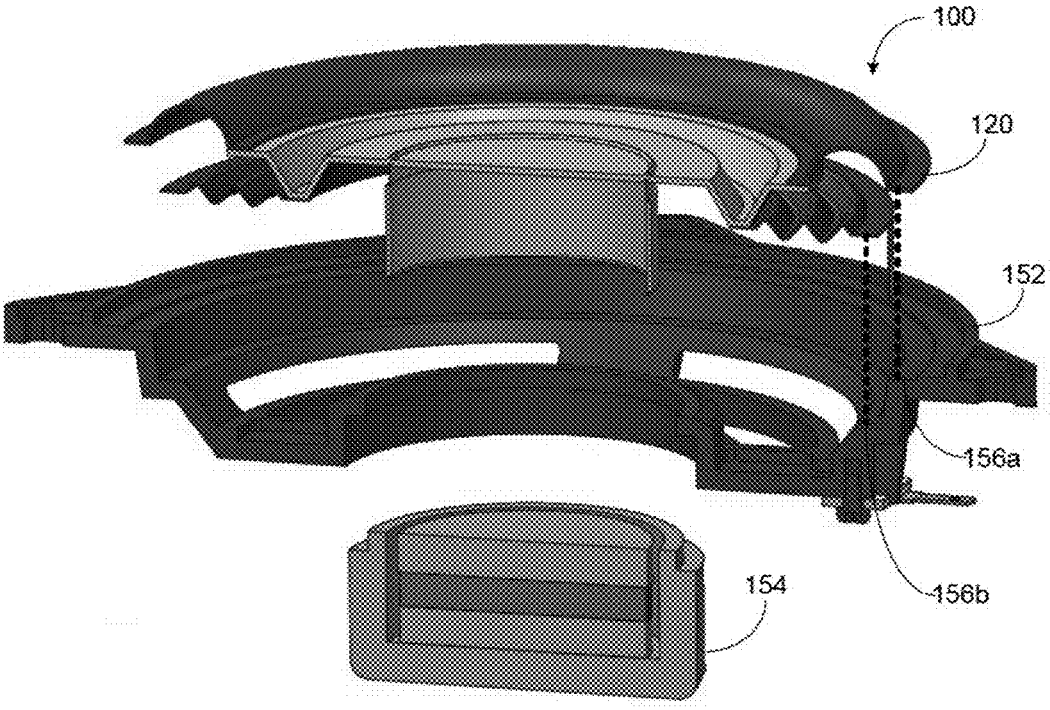
FIG. 1D shows an example second group of components for the first loudspeaker configuration, according to an embodiment of the present application.

FIG. 1D shows an example second group of components for the first loudspeaker configuration 100, according to an embodiment of the present application. In one example, the second group of components may include the first sub-assembly 120, the loudspeaker frame 152, and the magnetic structure 154. In one case, magnetic structure 154 may be coupled to a central portion of the loudspeaker frame 152 to form a second sub-assembly. The first sub-assembly 120 may then be coupled to the loudspeaker frame 152 such that the voice coil 108 may be suspended at least partially within the magnetic gap of the magnetic structure 154. As shown, an outer rim of the first suspension element 102 may be coupled to a first surface 156*a* on the loudspeaker frame 152, and an outer rim of the second suspension element 106 may be coupled to a second surface 156*b* on the loudspeaker frame. As with the case of coupling to the continuous diaphragm 104, the first suspension element 102 and the second suspension element 106 may be coupled with to the loudspeaker frame 152 using adhesive substances.

In one example, according to an embodiment of the present application, a circumferential spacer element may be provided to aid in an assembly of a loudspeaker configuration. In one case, the circumferential spacer element may be configured to be coupled to the outer rim of a first suspension element, or "surround" along a first surface and coupled to the outer rim of the second suspension element, "spider" along a second surface as part of a sub-assembly. The circumferential spacer element may further be configured to be coupled to a loudspeaker frame along a third, outer surface. Similar to the loudspeaker configuration 100, an inner rim of the first suspension element may be coupled to an outer rim of a continuous diaphragm, and an inner rim of the second suspension element may be coupled to a lower surface of the diaphragm or a voice coil coupled to a central portion of the lower surface of the diaphragm. The loudspeaker frame may be coupled to a magnetic structure, such that the voice coil may be suspended at least partially within the magnetic gap of the magnetic structure when the circumferential spacer element is coupled to the loudspeaker frame. In some cases, the circumferential spacer element may aid in an assembly of the loudspeaker configuration.

As indicated above and further discussed below, the present application involves a loudspeaker configuration and assembly of the loudspeaker configuration. In one aspect, a loudspeaker is provided. The loudspeaker includes a frame, a voice coil, a magnetic structure having a magnetic gap, a first suspension element having an inner rim and an outer rim, and a diaphragm having a circumferential outer rim. The circumferential outer rim of the diaphragm is attached to the inner rim of the first suspension element, and the voice coil is attached to a lower surface of the diaphragm. The loudspeaker further includes a second suspension element having an inner rim and an outer rim. The inner rim of the second suspension element is attached to the lower surface of the diaphragm. The loudspeaker also includes a circumferential spacer element having a first surface and a second surface. The outer rim of the first suspension element is attached to the first surface of the circumferential spacer element. The outer rim of the second suspension element is attached to the second surface of the circumferential spacer element. The circumferential spacer element is coupled to the frame such that the voice coil is suspended at least partially within the magnetic gap of the magnetic structure.

In another aspect, a circumferential spacer element of a loudspeaker is provided. The circumferential spacer element includes a first surface attached to an outer rim of a first suspension element. An inner rim of the first suspension element is attached to a circumferential outer rim of a diaphragm having a continuous surface, and a central portion of the diaphragm is coupled to a voice coil. The circumferential spacer element further includes a second surface attached to an outer rim of a second suspension element. An inner rim of the second suspension element is coupled to a lower surface of the voice coil. The circumferential spacer element has a structural shape configured to be coupled to a frame of the loudspeaker such that the voice coil is suspended at least partially within a magnetic gap of a magnetic structure of the loudspeaker.

In yet another aspect, a method for assembling a loudspeaker is provided. The method involves (a) providing a first sub-assembly. The first sub-assembly includes a diaphragm having a continuous lower surface, an outer rim and a central portion, a voice coil coupled to the central portion of the diaphragm, a circumferential spacer element having a first surface and a second surface, and a first suspension element having an inner rim and an outer rim. The outer rim of the first suspension element is attached to the first surface of the circumferential spacer element, and the inner rim of the first suspension element is attached to the outer rim of the diaphragm. The first sub-assembly also includes a second suspension element having an inner rim and an outer rim. The outer rim of the second suspension element is attached to the second surface of the circumferential spacer element, and the inner rim of the second suspension element is attached to diaphragm central portion of the first sub-assembly. The method further involves (b) providing a second sub-assembly. The second sub-assembly includes a loudspeaker frame having a central portion and an outer portion, and a magnetic structure having a magnetic gap. The magnetic structure is coupled to the central portion of the loudspeaker frame. The method also involves (c) coupling the circumferential spacer element of the first sub-assembly with the outer portion of the loudspeaker frame of the second sub-assembly such that the voice coil of the first sub-assembly is suspended at least partially within a magnetic gap of the magnetic structure of the second sub-assembly.

In another aspect, a diaphragm structure for a loudspeaker is provided. The diaphragm structure includes a continuous central portion having a lower surface. The lower surface of the continuous central portion is attached to a voice coil of the loudspeaker via a first coupler. The diaphragm structure also includes an outer portion having an outer rim. The outer rim of the outer portion is attached to an inner rim of a first suspension element attached to a frame of the loudspeaker such that the diaphragm suspends from the frame of the loudspeaker. The diaphragm structure further involves a circumferential middle section between the continuous central portion and outer portion of the diaphragm. The circumferential middle section is coupled via a second coupler to an inner rim of a second suspension element. The second suspension element is attached to the frame of the loudspeaker along an outer rim of the second suspension element.

Other embodiments, as those discussed in the following and others as can be appreciated by one having ordinary skill in the art are also possible.

II. Example Assemblies of Loudspeaker Configurations

Figure 2:
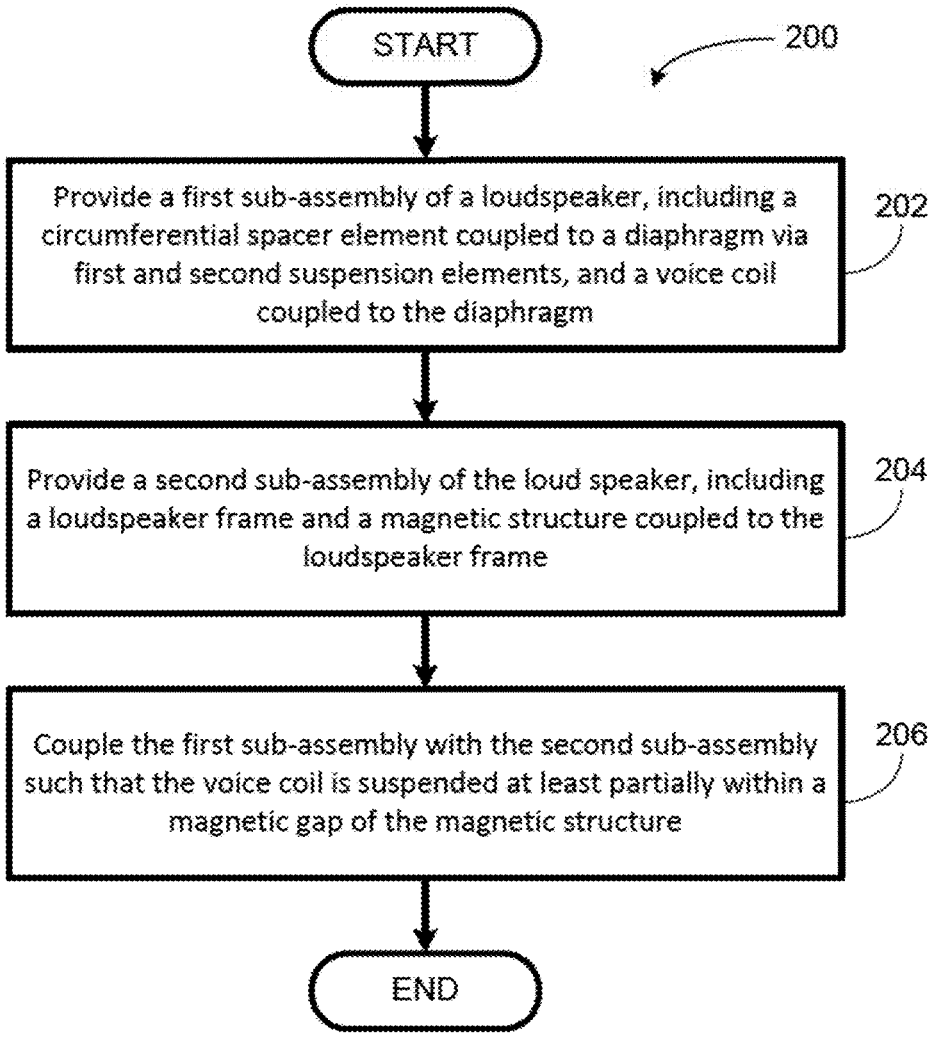
FIG. 2 shows a flow diagram for an example method for assembling an example second loudspeaker, according to an embodiment of the present application.

As suggested above, the present application provides a loudspeaker configuration and an assembly of the loudspeaker configuration. In one example, the loudspeaker configuration may allow for a loudspeaker to have reduced height. FIG. 2 shows a flow diagram for an example method 200 for assembling an example second loudspeaker configuration (such as that shown in FIG. 3D), according to an embodiment of the present application. Method 200 may include one or more operations, functions, or actions as illustrated by one or more of blocks 202-206. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the method 200 and other processes and methods disclosed herein, the flowchart shows functionality and operation of one possible implementation of present embodiments. As relating to manufacturing and/or assembling of a loudspeaker, the method 200 may be performed fully or in part by a system of mechanical actuators. In this regard, each block may represent a module, a segment, or a portion of program code, which includes one or more instructions executable by a processor to cause the mechanical actuators to implement specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the method 200 and other processes and methods disclosed herein, each block in FIG. 2 may represent circuitry that is wired to perform the specific logical functions in the process.

Figure 3A:
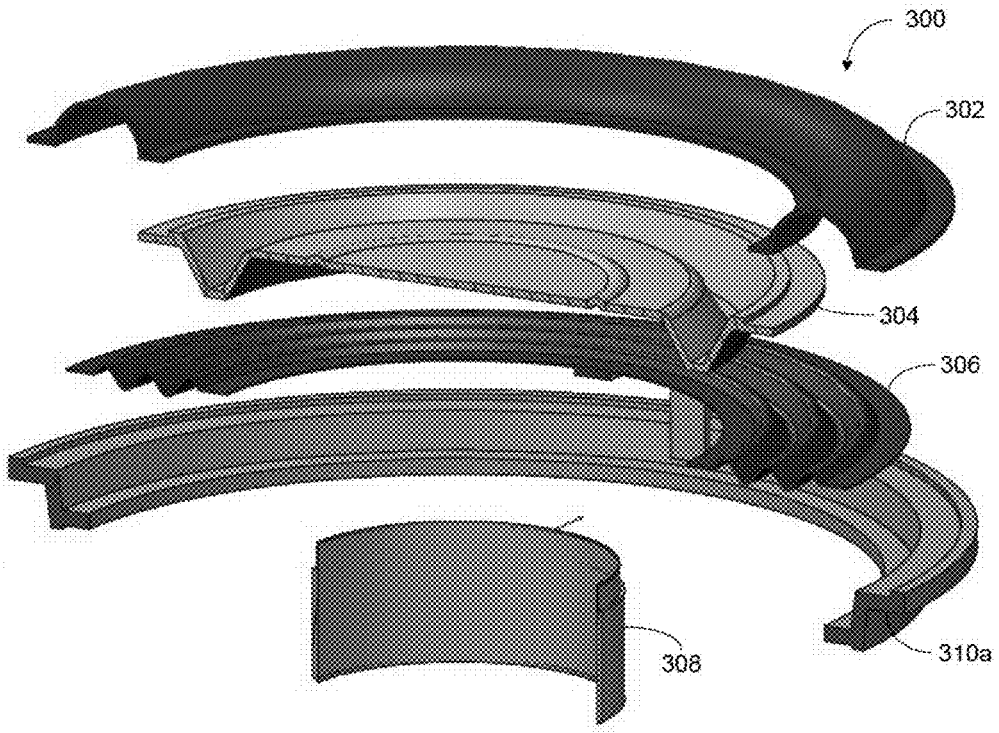
FIG. 3A shows an example first group of components for an example first sub-assembly of the second loudspeaker configuration, according to an embodiment of the present application.

Block 202 of the method 200 may involve providing a first sub-assembly 300 of a loudspeaker configuration as shown in FIG. 3A. As shown, the first sub-assembly 300 may include a diaphragm 304 having a continuous lower surface, a circumferential outer rim, and a central portion, a voice coil 308, a circumferential spacer element 310*a* having a first surface and a second surface, a first suspension element 302 having an inner rim and an outer rim, and a second suspension element 306 having an inner rim and an outer rim. As shown and discussed above, the diaphragm 304 may have a continuous surface within the circumferential outer rim of the diaphragm 304.

In one example, the circumferential spacer element may be made of a hard plastic material, or any other hard material. As shown in FIG. 3A, the circumferential spacer element may have a staggered two-tiered structure with an upper tier and a lower tier. In discussions herein, a first surface of the circumferential spacer element 310*a* may refer to an upper circumferential surface along the upper tier of the circumferential spacer element 310*a*, and a second surface of the circumferential spacer element 310*a* may refer to an upper circumferential surface along the lower tier of the circumferential spacer element 310*a*.

In one case as shown, the upper tier of the circumferential spacer element 310*a* may have a circumferential opening wider than a circumferential opening of the lower tier of the circumferential spacer element 310*a*. In another case, a circumferential opening of the lower tier of a circumferential spacer element may be wider than a circumferential opening of the upper tier of the circumferential spacer element. As will be discussed later, different structural configurations of the circumferential spacer element may be implemented for different reasons. In either case, the tiered structure of the circumferential opening may be configured to structurally match a structure of a loudspeaker frame so as to securely be coupled to the loudspeaker frame, as will be further discussed below. As indicated, other structural shapes and configurations of the circumferential spacer element 310*a* may also be possible for matching the structure of the loudspeaker frame and for achieving the purpose of the circumferential spacer element 310*a* discussed herein.

Figure 3B:
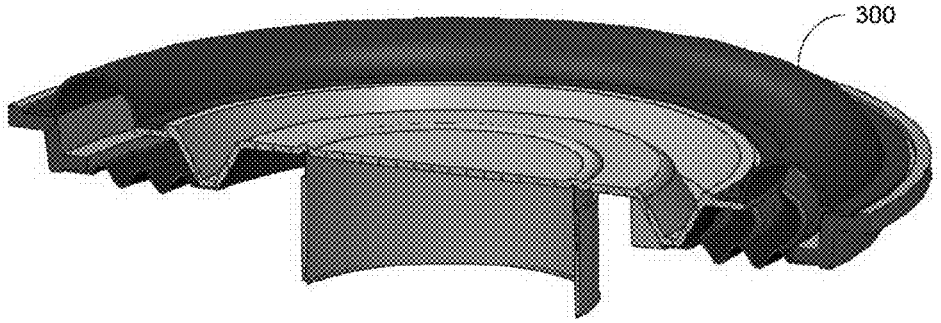
FIG. 3B shows the first sub-assembly of the second loudspeaker configuration, according to an embodiment of the present application.

FIG. 3B shows the first sub-assembly of the second loudspeaker configuration, according to an embodiment of the present application. As shown, the first surface of the circumferential spacer element 310*a* may be attached to an outer rim of the first suspension element 302 and the second surface of the circumferential spacer element 310*a* may be attached to an outer rim of the second suspension element 306. Also shown, voice coil 308 may be coupled to the central portion of the continuous lower surface of the diaphragm 304, and an inner rim of the first suspension element 302 may be attached to the circumferential outer rim of the diaphragm 304. Further, the inner rim of the second suspension element 306 may be coupled to the lower surface of the diaphragm 304, as shown. In one case, the inner rime of the second suspension element 306 may be coupled to a circumferential region of the lower surface of the diaphragm 304 outside of the central portion of the diaphragm 304. As indicated previously, the inner rim of the second suspension element 306 may in some embodiments be coupled to the voice coil 308.

In one example, the first suspension element 302 may be attached to the first surface of the circumferential spacer element 310*a* using a first adhesive substance configured to bind a material of the outer rim of the first suspension element 302 to a material of the circumferential spacer element 310*a*. Similarly, the second suspension element 306 may be attached to the second surface of the circumferential spacer element 310*a* using a second adhesive substance configured to bind a material of the outer rim of the second suspension element 306 to the material of the circumferential spacer element 310*a*. In some cases, the first and second adhesive substances may be the same or similar adhesive substance, while in some other cases the first and second adhesive substances may be different types of adhesive substances, depending on the different materials of the first suspension element 302 and the second suspension element 306. In one example, the adhesive substances may be one or more of a glue substance, a cement substance, a mucilage substance, or a paste substance.

Figure 3C:
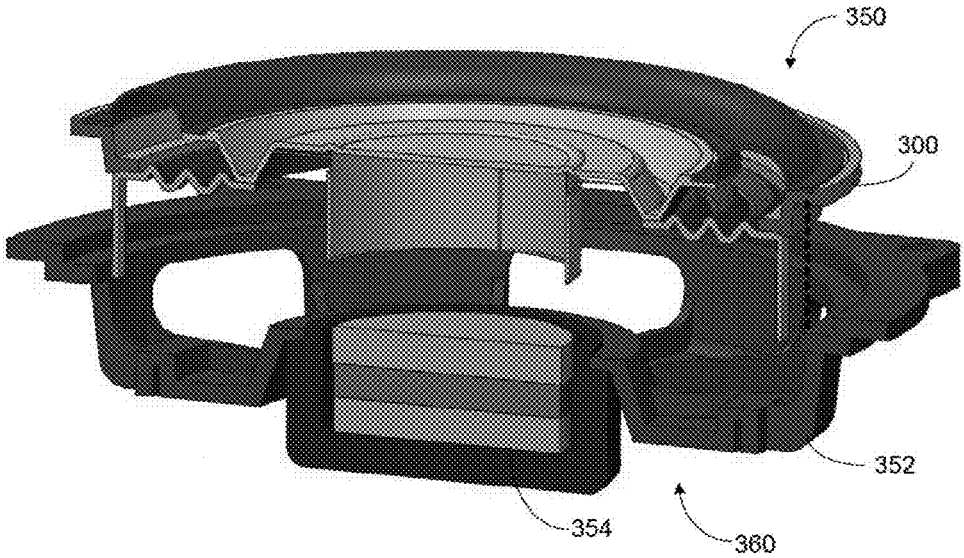
FIG. 3C shows an example second group of components for the second loudspeaker configuration, according to an embodiment of the present application.

Referring back to the method 200 of FIG. 2, block 204 may involve providing a second sub-assembly 360. In one example, the second sub-assembly may include a loudspeaker frame having a central portion and an outer portion, and a magnetic structure having a magnetic gap. In one example, the loudspeaker frame and the magnetic structure may be similar to the loudspeaker frame 152 and the magnetic structure 154, respectively shown in FIG. 1D. Accordingly, the magnetic structure may be configured to be coupled to the central portion of the loudspeaker frame, forming the second sub-assembly. FIG. 3C shows an example second group of components for a loudspeaker configuration 350, according to an embodiment of the present application. As shown, the second group of components may include the first sub-assembly 300 shown in FIG. 3B and the second sub-assembly 360 having a loudspeaker frame 352 and a magnetic structure 354, similar to the second sub-assembly discussed above.

Block 206 of the method 200 may involve coupling the circumferential spacer element 310*a* of the first sub-assembly 300 with the outer portion of the loudspeaker frame 352 of the second sub-assembly 360 such that the voice coil 308 of the first sub-assembly 300 may be suspended at least partially within a magnetic gap of the magnetic structure 354 of the second sub-assembly 360. In other words, similar to the assembly of the loudspeaker configuration 100 discussed above, block 206 may involve the first sub-assembly 300 and the second sub-assembly 360 being coupled to form the loudspeaker configuration 350.

As suggested previously, the circumferential spacer element 310*a* may have an outer surface that structurally matches an inner surface of the loudspeaker frame 352, such that the circumferential spacer element 310*a* may be securely coupled to the loudspeaker frame 352 along a portion of an inner surface of the frame. In one example, the portion of the inner surface along which the circumferential spacer element 310*a* may be attached may be located on the outer portion of the loudspeaker frame 352. In some cases, the circumferential spacer element 310*a* may be securely coupled to the loudspeaker frame 352 using an adhesive substance configured to bind a material of the circumferential spacer element 310*a* to a material of the loudspeaker frame 352. In one example, the circumferential spacer element 310*a* and the loudspeaker frame 352 may be securely coupled via a snap-fit mechanism. In another example, the outer surface of the circumferential spacer element 310*a* and the inner surface of the loudspeaker frame 352 may be complimentarily threaded such that the circumferential spacer element 310*a* may be securely screwed into the loudspeaker frame 352. Other examples are also possible. Further, as suggested above, the structural shape of the circumferential spacer element 310*a* may be configured such that the voice coil 308 may be suspended at least partially within a magnetic gap of the magnetic structure 354 when the circumferential spacer element 310*a* is coupled to the loudspeaker frame 352.

Referring back to the loudspeaker configuration 100 of FIGS. 1A-1D, difficulties may occur during assembly of the loudspeaker configuration 100 when coupling the outer rim of the first suspension element 102 and the outer rim of the second suspension element 106 to the loudspeaker frame 152. In some cases, the difficulties may occur because insufficient pressure may be applied to the outer rim of the second suspension element 106 when adhering both the outer rim of the first suspension element 102 and the outer rim of the second suspension element 106 to the loudspeaker frame 152 at the same time when the first sub-assembly 120 is being coupled to the loudspeaker frame 152.

In some cases, the circumferential spacer element 310*a* may be provided to remedy the difficulties. For instance, the circumferential spacer element 310*a* may aid in the assembly of the loudspeaker configuration 350 by providing a means and/or surface to apply pressure during adhesion of the outer rim of second suspension element 306 that may otherwise not be available without the circumferential spacer element 310*a*. Because the circumferential spacer element 310*a* may be configured to be coupled to the frame, the circumferential spacer element 310*a* may be, by extension a portion of the loudspeaker frame 352. Accordingly, the first suspension element 302 and the second suspension element 306 may both be effectively coupled to the loudspeaker frame upon coupling the first sub-assembly 300 to the second sub-assembly 360.

Figure 3D:
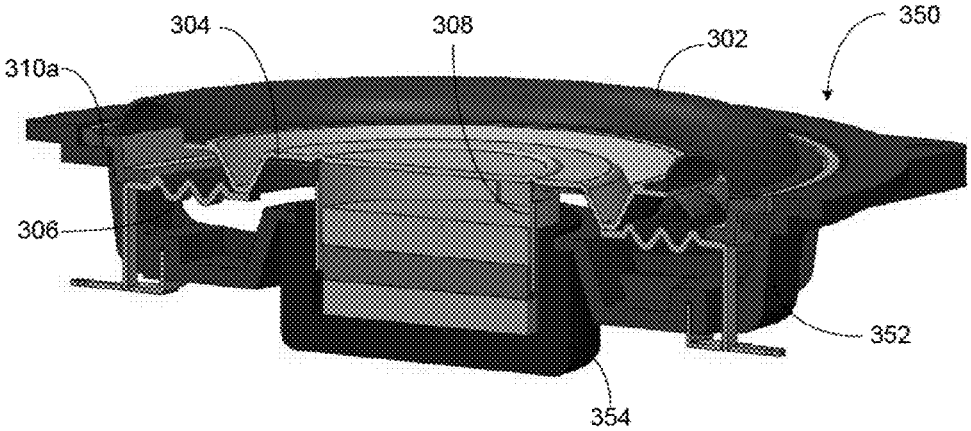
FIG. 3D shows the configuration of the second loudspeaker, according to an embodiment of the present application.

FIG. 3D shows the loudspeaker configuration 350, according to an embodiment of the present application. As shown, the loudspeaker configures 350 includes the frame 352, the voice coil 308, the magnetic structure 354 having the magnetic gap, the first suspension element 302 having an inner rim and an outer rim, the diaphragm 304 having a circumferential outer rim, the second suspension element 306 having an inner rim and an outer rim, and the circumferential spacer element 310*a* having a first surface and a second surface. As shown, the circumferential outer rim of the diaphragm 304 may be attached to the inner rim of the first suspension element 302, the voice coil 308 may be attached to a lower surface of the diaphragm 304, and the inner rim of the second suspension element 306 may be attached to the lower surface of the diaphragm 304, as shown. As suggested above, the inner rim of the second suspension element 306 may alternatively be attached to the voice coil 308. Further as shown, the outer rim of the first suspension element 302 may be attached to the first surface of the circumferential spacer element 310*a*, and the outer rim of the second suspension element 306 may be attached to the second surface of the circumferential spacer element 310*a*. As previously indicates, the circumferential spacer element 310*a* may be coupled to the frame 352 such that the voice coil 308 may be suspended at least partially within the magnetic gap of the magnetic structure 354.

As indicated above, different structural configurations for a circumferential spacer element may be possible. FIG. 4A shows a first example circumferential spacer element configuration 402. In particular, the configuration 402 shown may be the circumferential spacer element 310*a*, discussed above in connection to FIGS. 3A-3D. As discussed above, the circumferential spacer element 310*a* may have a staggered two-tiered structure with an upper tier and a lower tier, and as shown the upper tier of the circumferential spacer element 310*a* may have a circumferential opening wider than a circumferential opening of the lower tier of the circumferential spacer element 310*a*. In such a configuration, the first suspension element 302 may have an outer diameter greater than the outer diameter of the second suspension element 306.

Figure 4C:
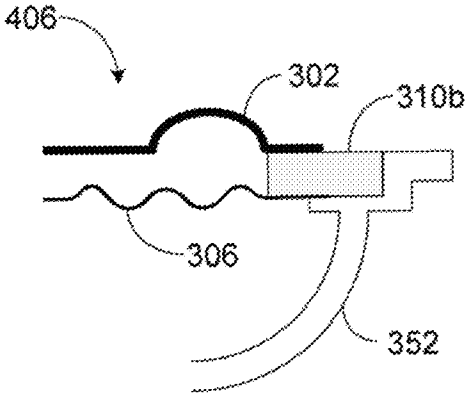
FIG. 4C shows a third example circumferential spacer element configuration, according to an embodiment of the present application.
Figure 4D:
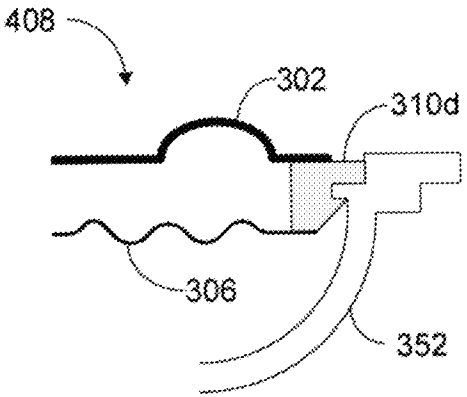
FIG. 4D shows a fourth example circumferential spacer element configuration, according to an embodiment of the present application.
Figure 4A:
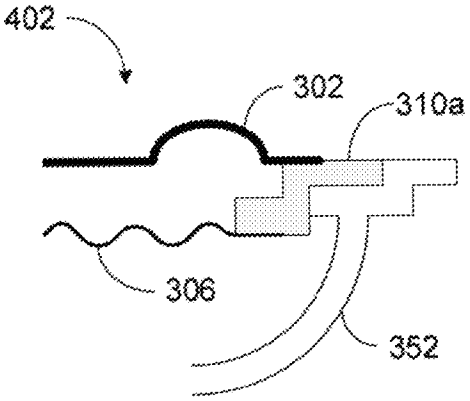
FIG. 4A shows a first example circumferential spacer element configuration, according to an embodiment of the present application.
Figure 4B:
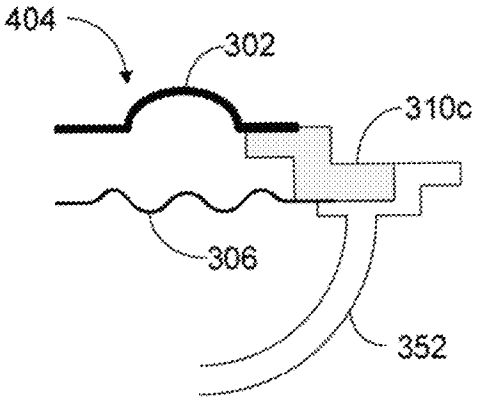
FIG. 4B shows a second example circumferential spacer element configuration, according to an embodiment of the present application.

FIG. 4B shows a second example circumferential spacer element configuration 404 with a circumferential spacer element 310*b*. In this case, the circumferential spacer element 310*b* may also have a staggered two-tiered structure. However, in this case, a circumferential opening of the lower tier of the circumferential spacer element 310*b* may be wider than a circumferential opening of the upper tier of the circumferential spacer element 310*b*. In this configuration, the first suspension element 302 may have an outer diameter smaller than the outer diameter of the second suspension element.

FIG. 4C shows a third example circumferential spacer element configuration 406 with a circumferential spacer element 310*c*. In this case, the circumferential spacer element 310*c* may be a simpler, ring-like structure without multiple-tiers or a staggered structure. In this configuration, the first suspension element 302 may have an outer diameter substantially the same as the outer diameter of the second suspension element 306.

FIG. 4D shows a fourth example circumferential spacer element configuration 408 with a circumferential spacer element 310*d*. In this case, the circumferential spacer element 310*d* may be configured to snap-in or to be screwed in to the loudspeaker frame 352 as previously discussed. While four different circumferential spacer element configurations are discussed herein, one having ordinary skill in the art will appreciate that other configurations are possible within the scope of the present application. Further, features from the different circumferential spacer element configurations may be combined to form additional circumferential spacer element configurations. For instance, the staggered two-tiered circumferential spacer element 310*b* of FIG. 3B may also be configured to snap-in or screwed in to the loudspeaker frame 352 as show with the circumferential spacer element 310*d* of FIG. 3D. Other examples are also possible.

As discussed in connection to the different configurations discussed above, the relative outer diameters of the first suspension element 302 and second suspension element 306 may be different or substantially the same. The relative outer diameters, among various other factors may contribute to variables in audio output from the loudspeaker. For instance, given the same material, a suspension element having a smaller diameter may be more rigid and respond to a movement of the voice coil and/or diaphragm differently. As such, in some cases, the configuration of the circumferential spacer element for a loudspeaker may be chosen at least partially based on other predetermined design parameters for the particular loudspeaker. In some other cases, the other design parameters for the particular loudspeaker may be determined based at least partially on the chosen circumferential spacer element. Other example configurations and embodiments may also be possible.

IV. Conclusion

As indicated above, the present application involves a loudspeaker configuration and assembly of the loudspeaker assembly. In one aspect, a loudspeaker is provided. The loudspeaker includes a frame, a voice coil, a magnetic structure having a magnetic gap, a first suspension element having an inner rim and an outer rim, and a diaphragm having a circumferential outer rim. The circumferential outer rim of the diaphragm is attached to the inner rim of the first suspension element, and the voice coil is attached to a lower surface of the diaphragm. The loudspeaker further includes a second suspension element having an inner rim and an outer rim. The inner rim of the second suspension element is attached to the lower surface of the diaphragm. The loudspeaker also includes a circumferential spacer element having a first surface and a second surface. The outer rim of the first suspension element is attached to the first surface of the circumferential spacer element. The outer rim of the second suspension element is attached to the second surface of the circumferential spacer element. The circumferential spacer element is coupled to the frame such that the voice coil is suspended at least partially within the magnetic gap of the magnetic structure.

In another aspect, a circumferential spacer element of a loudspeaker is provided. The circumferential spacer element includes a first surface attached to an outer rim of a first suspension element. An inner rim of the first suspension element is attached to a circumferential outer rim of a diaphragm having a continuous surface, and a central portion of the diaphragm is coupled to a voice coil. The circumferential spacer element further includes a second surface attached to an outer rim of a second suspension element. An inner rim of the second suspension element is coupled to the voice coil. The circumferential spacer element has a structural shape configured to be coupled to a frame of the loudspeaker such that the voice coil is suspended at least partially within a magnetic gap of a magnetic structure of the loudspeaker.

In yet another aspect, a method for assembling a loudspeaker is provided. The method involves (a) providing a first sub-assembly. The first sub-assembly includes a diaphragm having a continuous lower surface, an outer rim and a central portion, a voice coil coupled to the central portion of the diaphragm, a circumferential spacer element having a first surface and a second surface, and a first suspension element having an inner rim and an outer rim. The outer rim of the first suspension element is attached to the first surface of the circumferential spacer element, and the inner rim of the first suspension element is attached to the outer rim of the diaphragm. The first sub-assembly also includes a second suspension element having an inner rim and an outer rim. The outer rim of the second suspension element is attached to the second surface of the circumferential spacer element, and the inner rim of the second suspension element is attached to diaphragm central portion of the first sub-assembly. The method further involves (b) providing a second sub-assembly. The second sub-assembly includes a loudspeaker frame having a central portion and an outer portion, and a magnetic structure having a magnetic gap. The magnetic structure is coupled to the central portion of the loudspeaker frame. The method also involves (c) coupling the circumferential spacer element of the first sub-assembly with the outer portion of the loudspeaker frame of the second sub-assembly such that the voice coil of the first sub-assembly is suspended at least partially within a magnetic gap of the magnetic structure of the second sub-assembly.

In another aspect, a diaphragm structure for a loudspeaker is provided. The diaphragm structure includes a continuous central portion having a lower surface. The lower surface of the continuous central portion is attached to a voice coil of the loudspeaker via a first coupler. The diaphragm structure also includes an outer portion having an outer rim. The outer rim of the outer portion is attached to an inner rim of a first suspension element attached to a frame of the loudspeaker such that the diaphragm suspends from the frame of the loudspeaker. The diaphragm structure further involves a circumferential middle section between the continuous central portion and outer portion of the diaphragm. The circumferential middle section is coupled via a second coupler to an inner rim of a second suspension element. The second suspension element is attached to the frame of the loudspeaker along an outer rim of the second suspension element.

The descriptions above disclose various example systems, apparatus, and articles of manufacture. Such examples are merely illustrative and should not be considered as limiting. Accordingly, while the above describes example systems, apparatus, and/or articles of manufacture, the examples provided are not the only way(s) to implement such systems, apparatus, and/or articles of manufacture.

Additionally, references herein to an "embodiment" means that a particular feature, structure, or characteristic described in connection with the embodiment can be included in at least one example embodiment of the invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

We claim:

1. A loudspeaker comprising:
- a frame;
- a voice coil;
- a magnetic structure comprising a magnetic gap;
- a surround;
- a spider; and
- a circumferential spacer element comprising:
  - a first tier attached to an outer rim of the surround; and
  - a second tier attached to an outer rim of the spider, wherein the circumferential spacer element is coupled to the frame such that the voice coil is suspended at least partially within the magnetic gap.

2. The loudspeaker of claim 1, wherein the outer rim of the surround is attached to a first surface of the first tier of the circumferential spacer element, and wherein the frame is attached to a second surface of the first tier of the circumferential spacer element.

3. The loudspeaker of claim 1, wherein the outer rim of the spider is attached to a particular surface of the second tier of the circumferential spacer element, and wherein the frame is attached to the same particular surface of the second tier of the circumferential spacer element.

4. The loudspeaker of claim 1, further comprising a diaphragm, wherein an inner rim of the spider is attached to a lower surface of the diaphragm.

5. The loudspeaker of claim 1, wherein an inner rim of the spider is attached to the voice coil.

6. The loudspeaker of claim 1, wherein the first tier of the circumferential spacer element has a circumferential opening that is wider than a circumferential opening of the second tier of the circumferential spacer element.

7. The loudspeaker of claim 1, wherein the second tier of the circumferential spacer element has a circumferential opening that is wider than a circumferential opening of the first tier of the circumferential spacer element.

8. The loudspeaker of claim 1, wherein the frame comprises a inner surface that structurally matches an outer surface of the circumferential spacer element.

9. A circumferential spacer element of a loudspeaker, comprising:
- a first tier attached to an outer rim of a surround, wherein an inner rim of the surround is attached to an outer rim of a diaphragm, and wherein a central portion of the diaphragm is coupled to a voice coil; and
- a second tier attached to an outer rim of a spider, wherein an inner rim of the spider is attached to a lower surface of the diaphragm, and wherein the circumferential spacer element has a structural shape configured to be coupled to a frame of the loudspeaker such that the voice coil is suspended at least partially within a magnetic gap of a magnetic structure of the loudspeaker.

10. The circumferential spacer element of claim 9, wherein the diaphragm has a continuous lower surface.

11. The circumferential spacer element of claim 9, wherein the first tier and the second tier are staggered.

12. The circumferential spacer element of claim 9, wherein an outer surface of the circumferential spacer element structurally matches an inner surface of the frame of the loudspeaker.

13. A method for assembling a loudspeaker, the method comprising:
- (a) providing a first sub-assembly comprising:
  - a voice coil;
  - a surround;
  - a spider; and
  - a circumferential spacer element comprising:
  - a first tier attached to an outer rim of the surround; and
  - a second tier attached to an outer rim of the spider;
- (b) providing a second sub-assembly comprising:
  - a loudspeaker frame; and
  - a magnetic structure coupled to a central portion of the loudspeaker frame; and
- (c) coupling the circumferential spacer element of the first sub-assembly with the loudspeaker frame of the second sub-assembly such that the voice coil of the first subassembly is suspended at least partially within a magnetic gap of the magnetic structure of the second sub-assembly.

14. The method of claim 13, wherein providing the first sub-assembly further comprises:

attaching the outer rim of the surround to a first surface of the first tier of the circumferential spacer element; and wherein coupling the circumferential spacer element of the first sub-assembly to the loudspeaker frame of the second sub-assembly comprises attaching the loudspeaker frame to a second surface of the first tier of the circumferential spacer element.

15. The method of claim 13, wherein providing the first sub-assembly further comprises attaching the outer rim of the spider to a particular surface of the second tier of the circumferential spacer element; and wherein coupling the circumferential spacer element of the first sub-assembly to the loudspeaker frame of the second sub-assembly comprises attaching the loudspeaker frame to the same particular surface of the second tier of the circumferential spacer element.

16. The method of claim 13, wherein an inner rim of the spider is attached to the voice coil.

17. The method of claim 13, wherein the first sub-assembly further comprises a diaphragm, and wherein an inner rim of the spider is attached to a lower surface of the diaphragm.

18. The method of claim 13, wherein the first sub-assembly further comprises a diaphragm having a continuous lower surface.

19. The method of claim 13, wherein coupling the circumferential spacer element of the first sub-assembly to the loudspeaker frame of the second sub-assembly comprises structurally matching an outer surface of the circumferential spacer element to an inner surface of the loudspeaker frame.

20. The method of claim 13, wherein providing the first sub-assembly further comprises coupling the voice coil to a central portion of a diaphragm.

* * * * *